United States Patent [19]

Novak, Jr. et al.

[11] Patent Number: 4,630,665

[45] Date of Patent: Dec. 23, 1986

[54] BONDING ALUMINUM TO REFRACTORY MATERIALS

[75] Inventors: John W. Novak, Jr., New Kensington; Dennis R. Raines, Holiday Park; Donald J. Bray, Murrysville, all of Pa.

[73] Assignee: Aluminum Company of America, Pittsburgh, Pa.

[21] Appl. No.: 769,132

[22] Filed: Aug. 26, 1985

[51] Int. Cl.[4] ..... B22D 19/14

[52] U.S. Cl. ..... 164/97; 164/110; 228/263.12; 228/263.19

[58] Field of Search ..... 164/97, 108, 109, 110; 228/263.12, 263.19

[56] References Cited

U.S. PATENT DOCUMENTS

| | | | |
|---|---|---|---|
| 3,600,163 | 8/1971 | Badia et al. | 164/97 |
| 3,828,839 | 8/1974 | Dhingra | 164/97 |
| 4,053,011 | 10/1977 | Riewald et al. | 164/97 |

FOREIGN PATENT DOCUMENTS

| | | | |
|---|---|---|---|
| 31466 | 2/1982 | Japan | 164/97 |

OTHER PUBLICATIONS

R. D. Carnahan et al., "Some Observations on the Wetting of $Al_2O_3$ by Aluminum", 41 *J. Am. Ceramic Soc.*, [9], 343 (1958).

D. T. Livey et al., "The Wetting Properties of Solid Oxides and Carbides by Liquid Metals", *Proc. Plansee, Seminar II, Reutte/Tyrol*, 375 (1955).

*Primary Examiner*—Nicholas P. Godici
*Assistant Examiner*—Samuel M. Heinrich
*Attorney, Agent, or Firm*—Glenn E. Klepac,

[57] ABSTRACT

A method for bonding aluminum and aluminum alloys to refractory materials. A body of metal is heated to an elevated temperature at a total pressure above the vapor pressure of aluminum but less than atmospheric pressure. Oxygen partial pressure is maintained sufficiently low to prevent substantial oxidation of the metal. The heated body is contacted with a mass of refractory material and cooled, thereby forming a composite.

17 Claims, No Drawings

BONDING ALUMINUM TO REFRACTORY MATERIALS

FIELD OF THE INVENTION

The present invention relates to a technique for bonding aluminum and aluminum alloys to refractory materials.

BACKGROUND OF THE INVENTION

Methods for joining aluminum and aluminum alloys to refractory substances are known in the prior art. However, the prior art methods each suffer from one or more serious disadvantages making them less than entirely suitable for their intended purpose.

For example, Donomoto et al U.S. Pat. No. 4,450,207, issued May 22, 1984, describes composite materials comprising alumina or carbon reinforcing fibers compounded with a matrix metal consisting essentially of an aluminum-magnesium alloy. Composites made with alloys containing about 0.5–4.5 wt % magnesium were found to have optimum bending strength and bending fatigue strength. However, formulation of the composites requires pressurization at approximately 1000 kg/cm$^2$ in order to infiltrate the molten matrix metal into interstices of the mass of reinforcing fibers.

Riewald et al U.S. Pat. No. 4,012,204, issued Mar. 15, 1977, claims a composite material comprising an aluminum-lithium alloy matrix reinforced with polycrystalline alumina fibers. Molten alloy is infiltrated into the fibers by creating a pressure differential either by applying a vacuum to the mold or a positive pressure to the metal or a combination of both.

It is a principal objective of the present invention to provide a method of bonding aluminum and aluminum alloys to a refractory material wherein the refractory material is wet by the metal.

A further objective of the invention is to provide a method that does not require application of a pressure differential to combine a metal and refractory material into a composite.

An advantage of the present invention is that the method is useful for combining both pure aluminum and aluminum alloys with refractory materials.

Additional objectives and advantages of the present invention will become apparent to persons skilled in the art from the following specification and claims.

SUMMARY OF THE INVENTION

In accordance with the present invention, a body of aluminum or aluminum alloy is heated to an elevated temperature and bonded to a mass comprising a refractory material. Some suitable refractory materials are alumina, carbon, aluminum nitride, borsic, boron, silicon carbide, silicon nitride, SiAlON (an acronym for a material comprising aluminum nitride and silicon aluminum oxynitride wherein the aluminum and oxygen are in a solid solution of silicon nitride), titanium diboride, boron nitride and $B_4C$. Alumina fibers and carbon fibers are particularly preferred. The metal body is preferably heated to a temperature of about 1100°–1500° C., optimally about 1200°–1300° C. A particularly preferred temperature is about 1250° C.

Most aluminum alloys are suitable for practicing the present invention. However, when the refractory material comprises alumina, aluminum-lithium alloys should be avoided because of the tendency of lithium to react with alumina at elevated temperatures to form lithium aluminate.

Total pressure adjacent the heated body is controlled above the vapor pressure of aluminum but less than atmospheric pressure. Total pressure is generally less than about 1000 microns Hg and at least twice the vapor pressure of aluminum. Total pressure was 0.1 torr (100 microns Hg) in one example wherein a contact angle of less than 30° was observed between molten aluminum and a sapphire specimen.

Temperature of the body should be sufficiently high and total pressure adjacent the body sufficiently low to obtain wetting. Temperature and pressure conditions are preferred resulting in a contact angle of less than about 60°, more preferably less than about 45°. Conditions are optimally adjusted so that the contact angle is less than about 30°.

The partial pressure of oxygen adjacent the heated body should be sufficiently low to prevent substantial oxidation. An oxygen-getter may be employed to keep oxygen pressure low. Some suitable oxygen-getters are carbon, tungsten, zirconium and titanium. Carbon is particularly preferred. Oxygen partial pressure will generally be maintained less than about 10 microns Hg (0.01 torr). In addition, the body is held in a vessel comprising a non-oxide refractory substance. A graphite vessel is particularly preferred.

The method of the invention is useful for forming a composite comprising a metal matrix reinforced by fibers of a refractory material wherein the metal comprises aluminum or an aluminum alloy. A body of aluminum or aluminum alloy is heated to a temperature of about 1200°–1500° C. and introduced into a mold cavity containing a mass of fibers of a refractory material.

Total pressure adjacent the heated body is controlled above the vapor pressure of aluminum but less than atmospheric pressure. The partial pressure of oxygen adjacent the body is maintained sufficiently low to prevent substantial oxidation. Under such conditions, the heated metal is drawn by capillarity into interstices of the mass network. Upon cooling, there is formed a composite comrpising a matrix of aluminum or aluminum alloy reinforced by a network of refractory fibers.

DETAILED DESCRIPTION OF A PREFERRED EMBODIMENT

A set of tests was performed to determine the effect of various total pressures on contact angle between aluminum and alumina at 1250° C. All of these tests were performed in a furnace assembly having a graphite liner and a graphite heating element. The starting materials were high purity (99.99+%) aluminum and single crystal sapphire (alpha-$Al_2O_3$).

The procedure used is briefly summarized as follows:

(1) The furnace assembly was degassed by ramping temperature to 1400° C. while maintaining a vacuum of approximately $10^{-3}$ torr.

(2) An aluminum-sapphire specimen was preheated to 250° C. under a vacuum of $2\times10^{-4}$ torr and held under vacuum for 2 hours.

(3) The furnace was vented with oxygen-free argon; atmospheric pressure (737 torr) was maintained by purging with oxygen-free argon.

(4) Operating temperatures were obtained rapidly by ramping furnace temperature at about 75° C./minute.

After the furnace was heated to a predetermined temperature, contact angles between the sapphire and molten aluminum were measured by the sessile drop method. Contact angles were measured initially upon reaching 1250° C. and 20 minutes and 30 minutes after reaching temperature. Results are shown in Table I.

TABLE I

Contact Angles Between Aluminum and Sapphire at 1250° C.

| Pressure | Contact Angle | | |
|---|---|---|---|
| | Initial | 20 Minutes | 30 Minutes |
| 737 torr | 94° | 93° | 92° |
| 340 torr | 100° | 90° | — |
| 0.1 torr | — | <30° | — |

Examination of the cold specimen treated at 0.1 torr revealed that complete wetting of the top and sides of the sapphire had occurred. The layer of aluminum metal covering the sapphire was very uniform (i.e. bare sapphire could not be observed), and the aluminum adhered strongly to the sapphire surface.

In the test performed at atmospheric pressure, weight loss for the aluminum was less than 0.1 wt %. At 0.1 torr, total aluminum weight loss was about 3 wt %. This weight loss is not surprising because the vapor pressure of aluminum at 1250° C. is approximately 10 microns Hg (0.01 torr).

While the above results were obtained with a sapphire refractory material, the invention is also applicable to other substances that were traditionally thought to be "non-wetting" with respect to aluminum. Such substances include aluminum nitride, boron nitride an graphite.

The foregoing description of our invention is made solely for purposes of illustration. Persons skilled in the art will understand that numerous changes and modifications can be made therein without departing from the spirit and scope of the invention.

What is claimed is:

1. A method of bonding aluminum and aluminum alloys to a refractory material, comprising (a) heating a body of aluminum or an aluminum alloy to a temperature of about 1100°-1500° C., (b) controlling total pressure adjacent the heated body above the vapor pressure of aluminum but less than about 1,000 microns Hg, (c) maintaining the partial pressure of oxygen adjacent the heated body sufficiently low to prevent substantial oxidation of the body, the contact angle between the heated body and refractory material being less than about 45°, and (d) contacting the heated body with a mass comprising a refractory material.

2. A method according to claim 1 wherein said refractory material comprises alumina fibers or carbon fibers or mixtures thereof.

3. A method according to claim 1 wherein said body is heated to a temperature of about 1200°-1300° C.

4. A method according to claim 1 wherein the body is heated to a sufficiently high temperature to obtain a contact angle between the body and refractory material of less than about 30°.

5. A method according to claim 1 wherein the total pressure adjacent said body is at least twice the vapor pressure of aluminum.

6. A method according to claim 1 wherein step (c) includes performing step (d) in the presence of an oxygen-getter comprising carbon.

7. A method according to claim 1 wherein step (c) includes holding said body in a vessel comprising a non-oxide refractory substance.

8. A method according to claim 1 wherein the partial pressure of oxygen is less than about 10 microns Hg.

9. The method of claim 1 further comprising (e) cooling said body and said mass, thereby to form a composite comprising aluminum or an aluminum alloy and a refractory material.

10. A method according to claim 1 wherein step (c) includes holding said body in a graphite vessel.

11. A method according to claim 1 wherein there is no pressure differential between the heated body and refractory material.

12. A method of forming a composite comprising a metal matrix reinforced by fibers of a refractory material without application of a pressure differential, said method comprising (a) providing a mold defining a mold cavity containing a mass of fibers of a refractory material, said fibers forming a network defining a plurality of interstices, (b) heating a body of aluminum or an aluminum alloy to a temperature of about 1200°-1500° C., (c) introducing the heated body into the mold cavity so that the body contacts the mass of fibers, while controlling total pressure adjacent the heated body above the vapor pressure of aluminum but less than about 1,000 microns Hg and maintaining the partial pressure of oxygen adjacent the heated body sufficiently low to prevent substantial oxidation, said heated body thereby being drawn by capillarity into the interstices of said mass, and (d) cooling said body and said refractory material, thereby to form a composite comprising a matrix of aluminum or aluminum alloy reinforced by a network of refractory fibers.

13. The method of claim 12 wherein said body is heated to a temperature of about 1200°-1300° C.

14. The method of claim 12 wherein said refractory material comprises alumina or carbon or mixtures thereof.

15. A method according to claim 12 wherein step (c) includes holding said body in a graphite vessel.

16. A method according to claim 12 wherein the contact angle between the heated body and refractory material is less than about 45°.

17. A method according to claim 12 wherein the contact angle between the heated body and refractory material is less than about 30°.

* * * * *